US005535693A

United States Patent [19]

Verslype

[11] Patent Number: 5,535,693

[45] Date of Patent: Jul. 16, 1996

[54] SYSTEM FOR FURLING A SPINNAKER

[76] Inventor: Jean-Marc Verslype, 34 Rue De La Lande, 49000 Angers, France

[21] Appl. No.: 397,147

[22] PCT Filed: Sep. 8, 1993

[86] PCT No.: PCT/FR93/00861

§ 371 Date: Apr. 11, 1995

§ 102(e) Date: Apr. 11, 1995

[87] PCT Pub. No.: WO94/05544

PCT Pub. Date: Mar. 17, 1994

[30] Foreign Application Priority Data

Sep. 9, 1992 [FR] France ..... 92 10888
Jan. 22, 1993 [FR] France ..... 93 00762

[51] Int. Cl.[6] ..... B63H 9/04
[52] U.S. Cl. ..... 114/107
[58] Field of Search ..... 114/39.1, 102–108

[56] References Cited

U.S. PATENT DOCUMENTS 113,983 4/1871 Crossman ..... 114/105
3,310,018 3/1967 Roberts, Jr. et al. .
3,789,790 2/1974 Crall ..... 114/105

FOREIGN PATENT DOCUMENTS 745683 7/1970 Belgium .
0412640 2/1991 European Pat. Off. .

*Primary Examiner*—Edwin L. Swinehart
*Attorney, Agent, or Firm*—Merchant, Gould, Smith, Edell, Welter & Schmidt

[57] ABSTRACT

A system to be installed on a sail-boat for furling a spinnaker (1) and for remote fitting of the spinnaker (1) to a boom (2) swivel-mounted on the mast (3) of the sail-boat comprises a stay (4) offset with respect to the stay for the jib (5), a furling device (6) secured to the offset stay (4), at least one boom swivel-mounted on the mast (3), a spinnaker (1) fitted in the central part of its belly with at least one supple link (17) which can be attached to the furling device (6), a circular sheet (11) knotted at the end (9) of the boom (2) and passing through the tack of the spinnaker (1), the foot (13) of the mast (3) and a point (14) on the mast (3) at a predetermined height to serve as a topping lift for the articulated boom (2), said circular sheet (11) being passed through a cleat (12) and manoeuvered from the sail-boat cockpit to lower and raise said articulated boom (2) and bring the far end (9) of said boom into contact with said spinnaker (1).

34 Claims, 10 Drawing Sheets

SYSTEM FOR FURLING A SPINNAKER

BACKGROUND OF THE INVENTION

1. Field of the Invention

The invention relates to the field of sail-boats.

More specifically, the invention relates to the rigging of sail-boats and especially spinnakers.

Spinnakers are well known in the field of sailing and are used to increase the sail surface area of boats in order to increase their speed under certain wind directions. Spinnakers take the shape of a light, very hollow triangular sail with a very large area. There are thus many shapes of spinnaker. Known spinnakers notably include radial, tri-radial and asymmetrical spinnakers. Radial and tri-radial spinnakers have a symmetrical shape along the longitudinal axis while asymmetrical spinnakers have a shape without a longitudinal axis of symmetry.

Spinnakers are generally made out of a very light synthetic fabric that enables them to:

be easily rigged, be easily filled with wind, occupy a relatively small volume when they are stowed.

Their domed shape when they are filled with wind furthermore enables them to pull the boat very efficiently.

Spinnakers are used essentially in downwind or quarter-wind sailing conditions, but experienced helmsmen are capable of using them under less favorable wind directions.

However, it is relatively difficult to handle spinnakers. Indeed, their great surface area and shape prevents them being unfurled when the sail-boat is still. They can only be sent up when the boat is on the move.

Furthermore, the size of their surface area makes them unusable in heavy weather. Their large surface area indeed may prove to be dangerous in a strong gale.

The spinnaker therefore can only be used when weather conditions permit it. In this case, it is unfurled in front of the sail-boat with its halyard point being fixed to a spinnaker halyard brought to the end of the mast, with its tack being kept away solely by the force of the wind that sweeps into it in fixing it to a boom (which may also be used for a Genoa-sail) fixed to the front mast of the sail-boat, and by tautening its free end by means of a sheet.

One of the problems raised by spinnakers lies in their flimsiness. Indeed, they are made of a light and relatively flimsy material as compared with other sails and can therefore easily get torn in a gale.

Another problem inherent in sails of this type lies in the fact that they can easily get wound around the stay, especially in light weather during a failed maneuver or when the helmsman lets down a little too much and takes the wind out of the spinnaker with the main-sail. A stay such as this is formed by a cable designed to stiffen the mast in the frontward direction in an essentially longitudinal direction. This type of cable, which may be tensioned by means of a rigging device, is also used as a support either for the jib or possibly for a Genoa-sail. Thus, when the spinnaker is wound about this stay, it is relatively difficult to release it. For this, speedy action is needed before the cloth of the spinnaker gets torn in chafing against the stay. At the same time, care has to be taken not to luff or jibe in placing the spanker-boom manually over the false position and holding it in this position until the turns of the spinnaker get unwound by themselves. If such an operation proves to be fruitless, then a crew member must be sent to the top of the mast to unhook the halyard from the spinnaker and climb down along the stay, undoing the turns as he goes along. If despite such an operation, the spinnaker cannot be unfurled, then it must be decided to cut it with a knife.

Yet another problem raised by spinnakers lies in the fact that they have to be lowered as soon as weather conditions change and that, to do this, a crew member has to be sent to the front of the boat. Once the spinnaker has been hauled down, it has to be folded and stowed in a bag except when it has to be brought out again when conditions permit it. It will therefore be understood that the maneuvering of a spinnaker with a small crew or a single crew member is not easy.

2. Description of the Prior Art

In order to resolve this problem, there already exists a prior art device taking the form of a tube slightly flared out at its lower end and designed to be mounted in a sliding manner on the spinnaker so as to cap it in order to spill when it is lowered and release it so that it can be unfurled when it is raised. Such a device, known as a "spinnaker tube", is provided in its upper part with an out-haul strap enabling the tube to be raised to uncover the spinnaker and in its lower part with an in-haul strap to lower the tube and spill the spinnaker. A tube such as this has a strop made of cable inside which the spinnaker is fixed, the halyard of the spinnaker for its part being secured to the upper end of the tube by means of a pulley receiving the out-haul strap.

A device such as this has the drawback of being incapable of being handled from the cockpit of the sail-boat and of requiring the presence of a crew member at the bows of the sail-boat to handle the in-haul and out-haul straps respectively to spill and unfurl the spinnaker.

Another drawback raised by spinnaker tubes results from the fact that they may get blocked when the tube is in a raised position and prevent the spilling of the spinnaker.

Yet another drawback inherent in such tubes lies in the fact that it is impossible for them to give the spinnaker to which they are a fixed a variable wind-exposed surface area.

There also exist known devices in the prior art designed to enable the furling of the jib or Genoa and various devices that enable the main sail to be wound on the mast or on the boom.

When there is no furling device, the halyard point of the jib (or Genoa-sail) is fixed to the halyard having the same name. The hoist of the jib, which has a bolt rope that strengthens it, is then secured throughout its length (from the tack to the halyard point) to the stay connecting the bows of the sail-boat to the mast and the jib is unfurled as and when the jib is fixed to the stay. Once the jib is completely unfurled, the jib halyard is frapped to the foot of the mast and the jib sheet is hauled taut depending on the force and direction of the wind.

The presence of a furling device makes it possible to avoid having to haul down the jib when it no longer has to be used by furling it around the stay. Conventionally, a furling device such as this takes the form of a tube designed to be positioned rotationally about this stay and having a length substantially equal to the height of the jib and having one or more longitudinal grooves in which the bolt rope of the jib may be made to slide, or other types of elements for hooking the jib. A furling device such as this furthermore has a furling drum with one end controlling the furling of the jib about the tube arranged about the stay. The use of a furling device such as this is as follows. When the jib is positioned on the furling device, the jib halyard is brought to the mast so as to be secured to the halyard point of the jib. The hoist of the jib is then inserted into the groove or grooves of the tube of the furling device and the jib is unfurled. Once the jib is in position, the jib halyard is frapped to the foot of the mast and the jib is wound about the tube of the furling device. When it is desired to send up the jib, all that needs to be done is to haul the jib sheet taut, this causing the unfurling of the sail and the winding of the end about the drum of the furling device. When it is desired to reduce the windward surface area of the jib or completely furl it, the end secured to the drum has to be drawn after having slackened the jib sheet.

Furling devices such as this, which may also be used to furl a Genoa-sail, avert the need to haul down this type of sail and make it possible to send it up very swiftly. However, they cannot be used except for sails having an entire side, namely the hoist, fixed to the stay.

There also exist furling devices in the prior art designed to be fixed to the mast of sail-boats and enable the furling of the main sail. These furling devices have a profile that matches the mast. Within these furling devices there is placed a furling tube operated by an end emerging at the foot of the mast. Devices such as this furthermore have a slider that matches the spanker-boom, on which there slides a pulley designed to be secured to the sheet point of the main-sail. When such a furling device is used, the main-sail may be furled within the profile fixed to the mast by action on the emerging end at the foot of the mast. When the main-sail has to be sent up, it suffices to make the main-sail slide on the slider of the spanker-boom.

All these furling devices may be motor-driven. There also exist furling devices that can be used to furl the main-sail on the spanker-boom.

The main-sail furling devices may be attached to the mast or the spanker-boom or may form an integral part thereof.

Just like the jib and/or Genoa-sail furling device, the main-sail furling devices can be used only for sails (main sails, storm sails) whose hoist is secured essentially throughout its height to the furling tube.

An aim of the invention is to provide a system that enables the furling of a spinnaker.

Another aim of the invention is to provide a system such as this enabling the positioning of the spinnaker on a boom, from the cockpit of the sail-boat.

Yet another aim of the invention is to propose a system such as this that makes it possible to free the foredeck of the boat, namely to avoid encumbering it with the folded boom or spinnaker.

Finally, another aim of the invention is to provide a system such as this enabling the partial deployment of the spinnaker depending on the force of the wind.

SUMMARY OF THE INVENTION

These different aims as well as others that shall appear hereinafter are achieved, by the invention, which relates to a system designed to be installed on a sail-boat in order to enable the furling of a spinnaker about a stay of said sail-boat and the maneuvering, at a distance, of said spinnaker characterized in that said system comprises:

a stay offset with respect to the jib stay, connecting the top of the mast to a fastening point located on the bows of said sail-boat, a furling device secured to said offset stay, at least one boom swivel-mounted on the mast, a spinnaker whose belly is provided in its central part with at least one flexible link that can be attached to said furling device and enables the furling of said spinnaker on a double thickness, starting from said central part, in such a way that only the sheet points and tacks of said spinnaker remain accessible, once the spinnaker is totally furled, and a circular sheet knotted at the far end of said swivel-mounted boom and passing through the tack of said spinnaker by the foot of the mast and by a point of the mast located at a predetermined height on this mast so that said circular sheet serves as a topping lift for said swivel-mounted boom, said circular sheet being capable of being frapped to a cleat and operated from the cockpit of the sail-boat to lower and raise said swivel-mounted boom and bring said far end of the boom into contact with the tack of said spinnaker.

Thus, according to the invention, a system such as this permits the use of a furling device for a spinnaker. The original characteristic according to which the sail is connected to the furling device not by one of its ends but by its central part enables the spinnaker to be furled gently from its middle. Said flexible link enables the furling of said spinnaker when it is being folded but does not hamper the motions of the spinnaker when it is unfurled.

Furthermore, according to a characteristic such as this, it is possible to partially furl the spinnaker and thus reduce its windward surface area. This may prove to be particularly useful when the wind is not strong enough to entirely fill out the spinnaker and increase the field of use of such a sail. Indeed, it often happens that, in low wind conditions, the captain hesitates to send up the spinnaker at the risk of making it shiver and getting wound about the stay. With the device according to the invention, it is always possible to gradually unfurl the spinnaker in order to see how it behaves as a function of the force and direction of the wind and, as the case may be, choose not to unfurl it completely.

According to the other essential characteristic of the invention wherein the system has a circular sheet enabling the swivel-mounted boom to be operated from the cockpit of the sail-boat, an unfurling of the spinnaker such as this is done more speedily. Indeed, it is no longer necessary to send a crew member to the front of the boat to fix the boom to the mast and hook the tack of the spinnaker to the far end of this boom in order to keep it at a sufficient distance away. An operation such as this may be done simply by slackening the circular sheet so as to bring the boom down so that its far end obligatorily comes into contact with the tack of the spinnaker (said circular sheet going through this tack) and then, by tautening this sheet to a cleat so that the boom is held in a given position.

The present invention is of particular value for small crews. For example, for a race with one-man crews, the helmsman will no longer have to put on his automatic pilot in order to unfurl the spinnaker since he can do it without leaving his station.

According to one variant of the invention, the flexible link connecting the spinnaker to the furling device is formed by a set of straps or sheets arranged essentially along the longitudinal axis of said spinnaker and having their ends secured to an essentially rectangular band that can be fixed to said furling device. The use of a set of a straps or sheets such as this is very easy since the cloth band to which they are linked may easily be inserted into the longitudinal groove or grooves with which these furling devices are generally provided. Furthermore, the use of such straps or sheets does not at all disturb the filling of the spinnaker with wind since their windward surface is almost zero. Each of the straps or sheets may be positioned so as to face one section of the tube of the furling device.

According to another variant of the invention, said flexible link is formed by a single strap or a single sheet secured to said furling device by means of a reinforced triangular cloth band that can be fixed to said furling device.

Preferably, said essentially triangular band is provided with reinforcing pieces each positioned so as to face a section of said tube of the furling device.

According to one variant, said straps or said sheets can be adjusted lengthwise so as to match the surface area of the spinnaker used.

Advantageously, said central part of the belly of the spinnaker receiving said flexible strap has a reinforcing piece. A reinforcing piece such as this enables the absorption of the tensile forces of the furling device transmitted to the cloth of the spinnaker by means of the flexible link and proves to be especially useful when this cloth is made of a flimsy synthetic material having a relatively low tear strength.

According to a particularly promising variant of the invention, said flexible link connecting said spinnaker to said furling device is fixed approximately at the part of the spinnaker that is at the greatest distance from the furling device, when the spinnaker is filled with wind.

Preferably, said offset stay supporting the furling device is offset longitudinally before the jib stay. In this way, the risk that the flexible link of the spinnaker may chafe against the jib stay is reduced.

Also preferably, said tack of said spinnaker is provided with a pulley receiving said circular sheet and being capable of working with the far end of said boom.

According to one variant of the invention, the system has two swivel-mounted booms on the mast and two circular sheets, one of the two booms being designed for the maneuvering of the spinnaker on the portside by means of the first circular sheet and the other of these booms being designed for starboard maneuvering of the spinnaker by means of the second circular sheet. When the spinnaker is installed on the furling device, the two lower points of the sail could be provided with both a sheet enabling the tautening of the spinnaker and a circular sheet enabling it to be brought into contact with the boom. Depending on whether it is sought to send up the spinnaker on the portside or on the starboard side, one of the two circular sheets and the opposite spinnaker sheet will be tautened. The two booms may also be advantageously used to move away the base of the spinnaker to the maximum extent and, in the event of a drop in wind, to limit the disorderly furling of the spinnaker above the tube of the furling device. In this way, all that is obtained is a shivering and not a flapping of the spinnaker, thus making it possible to retain mastery over the spinnaker since its two tacks are controlled.

Finally, the borders of the spinnaker will preferably have a reinforcement piece treated so as to withstand natural ultraviolet rays. Indeed, since the essential part of these borders remains exposed to natural light once the spinnaker is furled, such treatment will make it possible to delay the ageing of the spinnaker.

The invention also relates to a spinnaker forming part of the constitution of the system described and characterized in that its belly is provided in its central part with at least one flexible link that can be secured to a furling device, said flexible link enabling the furling, on said furling device, of said spinnaker when it is being folded but not hampering the movements of the spinnaker when it is unfurled.

Furthermore, the invention also relates to a spinnaker furling system that is an improvement on the previously described system with a view to reducing the strains placed on the spinnaker during the stage of folding by furling.

An object of the invention generally is a system such as this that can be easily operated at a distance by means of a single sheet and also relates to a device for the maneuvering of a spinnaker, characterized in that the spinnaker is provided with a becket located substantially at a point of the median line of the spinnaker, characterized in that said maneuvering device comprises:

firstly, a furling element comprising a furling web extending over at least a part of the height of the spinnaker, on the concave internal face side of said spinnaker; and secondly an attachment sheet that can be secured to a fastening point of said spinnaker and that crosses said becket towards a onward sending point located on said furling element.

According to a preferred embodiment of the invention, said becket is localized in the vicinity of the median part of the base of said spinnaker and is pierced in a reinforced region of said spinnaker.

Advantageously, said onward sending point for said attachment sheet is formed by a shackle or equivalent device.

To limit the travel of the shifting of the attachment sheet with respect to the spinnaker and enable the driving of the spinnaker during the exertion of a tensile force on said attachment sheet, said sheet is provided with at least one locking knot designed, during the maneuver, to abut the internal face or the external face of said becket.

According to an advantageous variant, said attachment sheet is extended, on the convex external face side of the spinnaker, towards the upper part of the spinnaker so as to force the attachment of said unfurled spinnaker towards the direction of said furling web when a tensile force is exerted on said attachment sheet. In this case, said attachment sheet is preferably fixed substantially at the halyard point of said spinnaker. Furthermore, advantageously, said attachment sheet is guided along the convex external face of said spinnaker by guide loops attached to said spinnaker. In this case, said guide loops extend preferably substantially along the median line of said spinnaker.

In order to make it easier to carry out the operations of sending up and folding the spinnaker, the maneuvering end of the attachment sheet is advantageously flapped on a cleat. Preferably, said cleat works together with a twin cleat designed to flap a sheet for controlling the rotation of said furling web.

Also in order to facilitate the spinnaker folding operation, said attachment sheet is extended into the lower part of the spinnaker alternately on the internal concave face side and the external concave face side of the spinnaker and then raised to the level of the highest becket so as to cause the concertina-type folding of said lower part of the spinnaker when the attachment sheet is tautened.

An object of the present invention is also to provide means enabling easy maneuvering of the above-described attachment sheet and the prevention of any interference between such a attachment sheet and the sheet that enables the activation of the furling element.

Said furling element is therefore preferably fitted out with an essentially cylindrical part designed to be positioned about said furling web so as to be secured to it and abut the upper flange of the furling drum of said furling element, said part being provided with at least one pulley essentially mounted radially with respect to the longitudinal axis of said part and constituting said onward sending point for said attachment sheet.

Preferably, said pulley is designed to be in the upper part of said essentially cylindrical part.

Also preferably, said pulley is flush with the surface of said part so as to go slightly beyond it.

Advantageously, the device has two pulleys positioned in one and the same vertical plane, said attachment sheet arriving between the two pulleys.

In such an example, the upper pulley preferably emerges further out of said cylindrical part than the lower pulley.

According to one aspect of the invention, said essentially cylindrical part may be integrated into said furling element.

According to another aspect of the invention, this part may be formed by at least two complementary elements that can be adapted around the furling web, notably after the positioning of the furling element around the spinnaker halyard.

Preferably, said part is provided in its lower part with means for anchoring the furling element to the drum.

Said furling element could also include a standard dual-drum furling device, the upper drum being designed to furl said attachment sheet and the lower drum being designed to furl the furling sheet.

According to the invention, it is then possible to provide for a cage around the drum making it easier to guide the attachment sheet and the furling sheet.

The upper flange could also include, at the inlet hole of the upper drum, an element making it easier to slide the sheet and prevent it being worn out by friction on the edge of said hole, for example a pulley.

BRIEF DESCRIPTION OF THE DRAWINGS

The invention as well as its many advantages will be understood more clearly from the following description of non-restrictive exemplary embodiments made with reference to the appended drawings, of which.

MORE DETAILED DESCRIPTION

Figure 1:
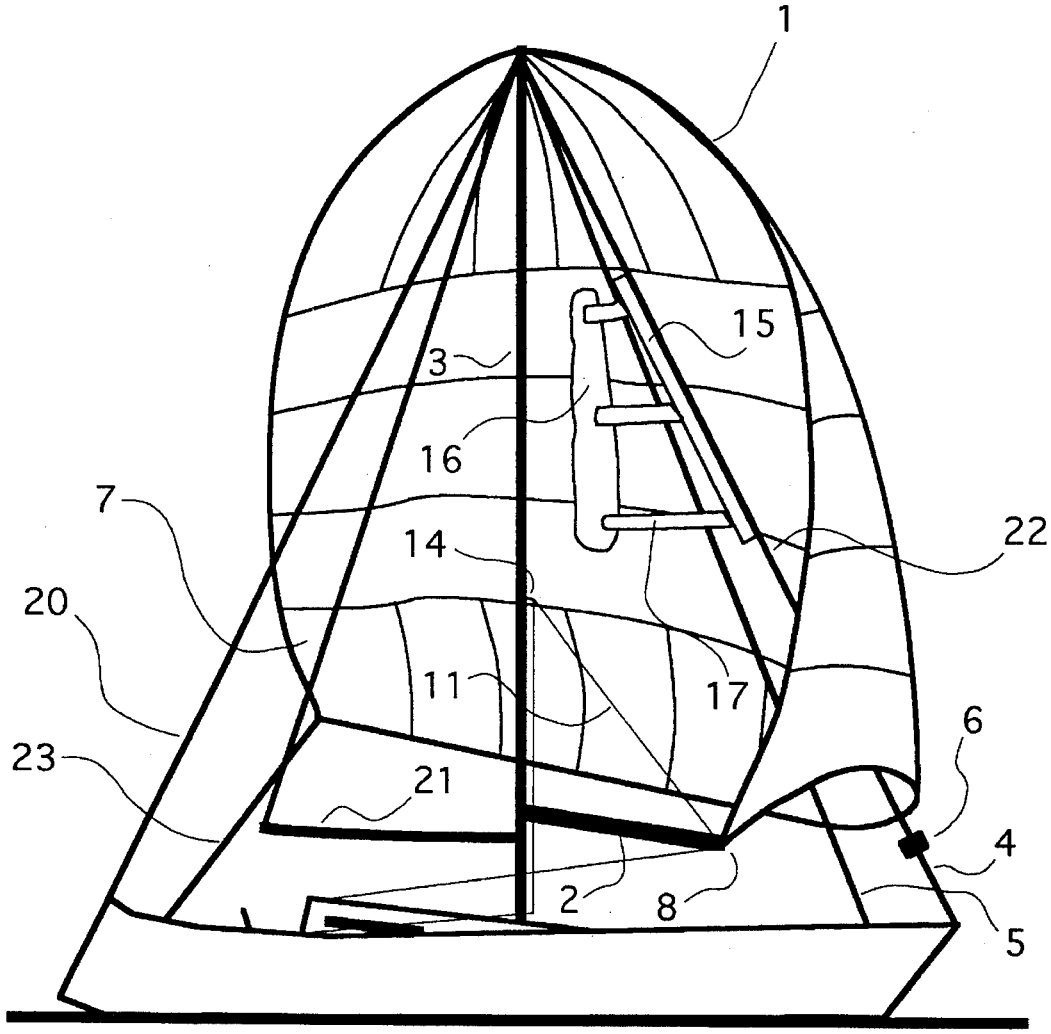
FIG. 1 shows a schematic view of a sail-boat fitted out with a system for the unfurling and maneuvering of a spinnaker according to the invention.

According to FIG. 1, a sail-boat is shown schematically in a side view with a spinnaker 1 unfurled on the portside. In order to make the present description clear, the other sails of this sail-boat are not shown. In particular, the main-sail is not shown. The spinnaker 1 with which the sail-boat is fitted is of the radial type. It will be noted however that the system according to the invention can be used with other types of spinnakers and notably with asymmetrical spinnakers.

Apart from the sails, the rigging of this sail-boat comprises a mast 3 stiffened in front by a stay 5 and in the rear by a shroud 20. Each of these elements may be connected, in a standard way, to the hull of the boat by a rigging device. In an equally conventional way, this sail-boat has a spanker-boom 21 receiving the main-sail.

According to the invention, the rigging of the sail-boat also includes a boom 2 swivel-mounted on the mast 3 so that it can take at least two positions:

a raised position in which this boom 2 is placed parallel to the mast 3 and in contact with it throughout its length, a lowered position in which the boom 2 is essentially perpendicular to the mast and can be used to move away the edge of the spinnaker 1.

It will be noted that swivel-mounted booms of this kind are already known in the prior art and are used to secure spinnakers and Genoa-sails. They prevent the need to set up the boom on the mast whenever the spinnaker or the Genoa-sail have to be sent up.

Again according to the invention, the rigging of this sail-boat includes an additional stay for joining the end of the mast 3 to the bows of the sail-boat. This additional stay 4 may be fixedly joined to the hull of the vessel by a rigging device similar to the stay 5 and the shroud 20. The stay 4 is fitted out with a furling device 6 whose longitudinal furling tube 22 is mounted around the stay 4. Conventionally, a tube 22 such as this may be provided in its upper part with means enabling the jib halyards and the spinnaker to be moved away.

According to the invention, the belly of the spinnaker 1 is provided in its central part with a flexible link formed by three straps 17 enabling the spinnaker 1 to be secured to the furling device 6. The straps 17 are connected to an essentially rectangular cloth band 15 secured to the furling device 6.

In order to prevent the cloth of the spinnaker from tearing under the effect of tensile forces exerted by the furling device 6 and transmitted by the straps 17, the zone by which the spinnaker is secured to the flexible link is provided with a reinforcing piece 16.

Furthermore, the additional stay 4 is longitudinally offset with respect to the stay 5 so that the unfurling of the spinnaker 1 is not hampered by this stay 5.

In FIG. 1, the spinnaker is shown while it is completely unfurled. It is bordered by a sheet 23 brought close to the cockpit of the sail-boat as a function of the wind force and wind direction. The tack 8 of the spinnaker 1 for its part is connected to a boom 2 swivel-mounted on the mast 3.

Again according to the invention, the sail-boat is fitted out with a circular sheet 11 secured to the far end of the swivel-mounted boom 2 passing through:

the tack 8 of the spinnaker 1, the foot of the mast 3, and a point of the mast located at a predetermined height so that said circular sheet can serve as a topping lift for the swivel-mounted boom.

Said circular sheet is frapped to a cleat that can be operated from the cockpit of the sail-boat.

A circular sheet such as this makes it possible, as shall be explained hereinafter in greater detail with reference to FIGS. 4 and 5, to lower the swivel-mounted boom 2 in such a way that the far end of this boom comes into contact with the tack 8 of the spinnaker 1.

The furling device 6 can be used to furl the spinnaker 1 from its central part in such a way that only the sheet point and the tack of the spinnaker remain accessible once the spinnaker is totally furled.

The advantages procured by the system according to the invention are numerous.

First of all, such a system makes it possible to avoid having to lower the spinnaker as soon as weather conditions are not appropriate for its use. In the framework of the invention, this spinnaker can be furled gradually and gently around the stay 4 offset with respect to the stay 5.

It is also possible, through the device of the invention, to carry out only the partial furling of the spinnaker 1 so as to reduce its windward surface. Up to now, it has been possible to use spinnakers only with their full sail surface, which has sometimes raised problems, for example when the wind is not quite sufficient to fill the spinnaker. In such a case, the shivering of this sail could lead to its being furled around the stay.

Yet another advantage of the system according to the invention lies in the fact that the operation of the swivel-mounted boom 2 can be done from the cockpit of the sail-boat. The circular sheet 11 passing through the tack 8 of the spinnaker 1 enables this boom to be lowered so that it necessarily comes into contact with this part of the sail.

Figure 2:
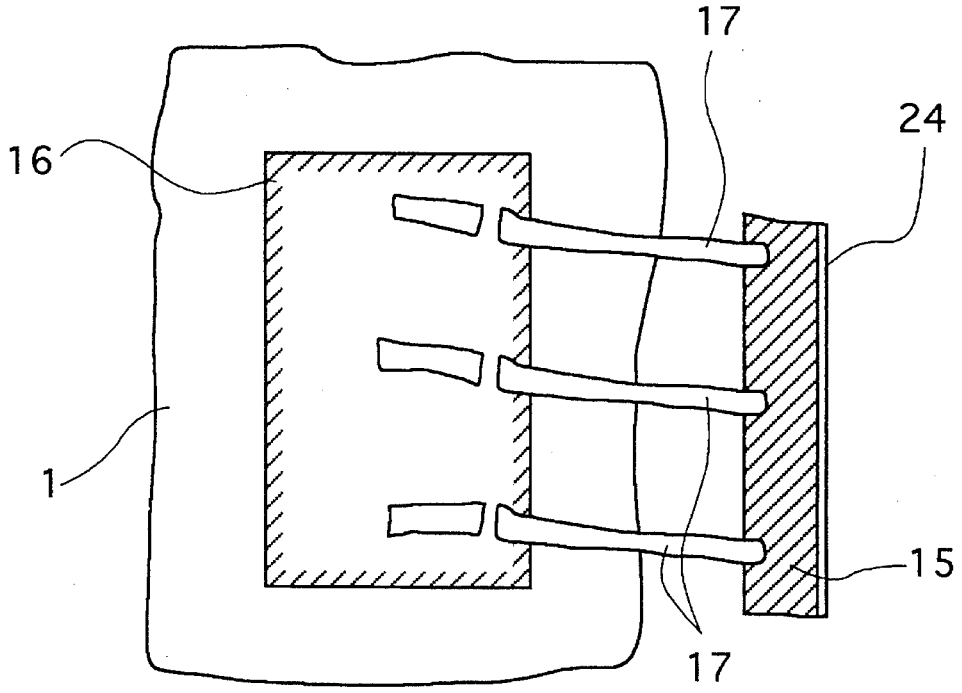
FIG. 2 shows an enlarged view of the flexible link secured to the spinnaker and the furling device of the sail-boat shown in FIG. 1.

Referring to FIG. 2, the flexible link securing the furling device 6 to the spinnaker 1 is shown in an enlarged view. A flexible link such as this is formed by a set of three straps 17 secured to an essentially rectangular cloth band 15.

The central part of the spinnaker i receiving the straps 17 is provided with a reinforcing piece 16 thermally bonded to the cloth of the spinnaker. Naturally, other means of securing than thermal bonding could be used to fasten this reinforcement piece to the cloth of the spinnaker 1. The straps 17 are sewn by one of their ends to the reinforcement piece 16 and to the cloth of the spinnaker, essentially perpendicularly to this cloth. These straps 17 have a length sufficient to enable the free deployment of the spinnaker and its filling with wind. The ends opposite to the ends connected to the spinnaker 1 are connected to the cloth band 15. This band is fitted out throughout its length with a bolt rope 24 that can easily be inserted into the groove of the longitudinal tube 22 of the furling device 6. The width of the band 15, for its part, it is small enough not to disturb the filling of the spinnaker. The straps may be spaced out with respect to one another by a sufficient distance to further the furling on the furling device. A model of a sail-boat fitted out with a flexible link such as this, having a total height of 1.50 m and, as flexible links, a set of nippers spaced out with respect to one another by 10 cm, has been tested. The tests have shown that a flexible link has no effect on the filling out of the spinnaker with wind.

Figure 3:
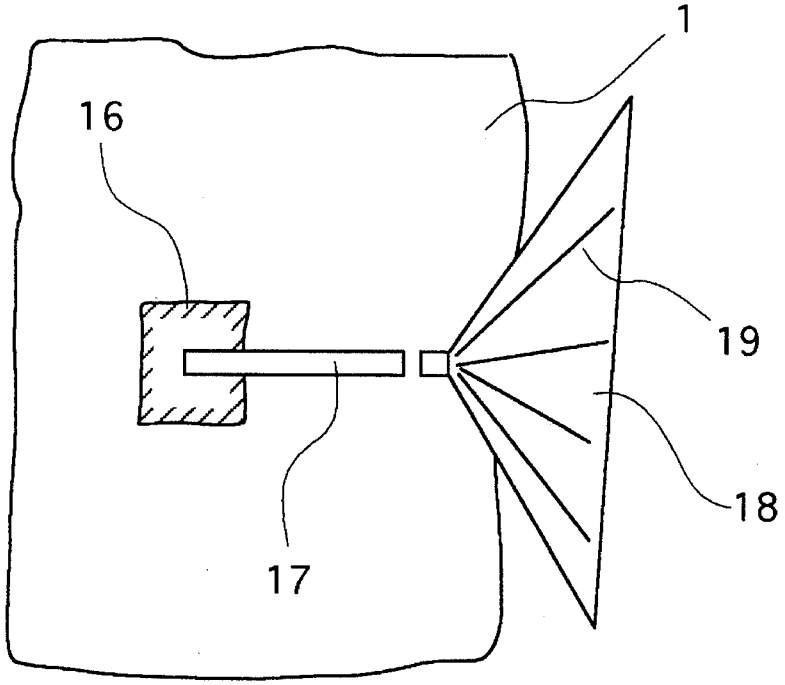
FIG. 3 shows an enlarged view of another variant embodiment of a flexible link that can be made to connect the spinnaker to the furling device.

In FIG. 3, another embodiment of the flexible link connecting the central part of the spinnaker 1 to the furling device 6 is shown. This flexible link is formed by a single strap 17 knotted to the central part of the spinnaker 1. To this end, a stiffening piece 16 is used to withstand the tensile forces transmitted by the furling device 6 by means of the strap 17. The strap 17, shown in a shortened form for purposes of the clarity of the description, is connected to an essentially triangular band 18 provided with stiffening pieces 19 and having a bolt rope 24 on one side, this bolt rope being capable of being inserted into the group of the furling device 6. The stiffening pieces 19 are positioned essentially on the triangular band 18 so that each one corresponds to a section of the tube 22 of the furling device 6. This embodiment of the flexible link has only a very small windward surface that is unlikely to spoil or hamper the filling of the spinnaker 1 with wind.

Figure 4:
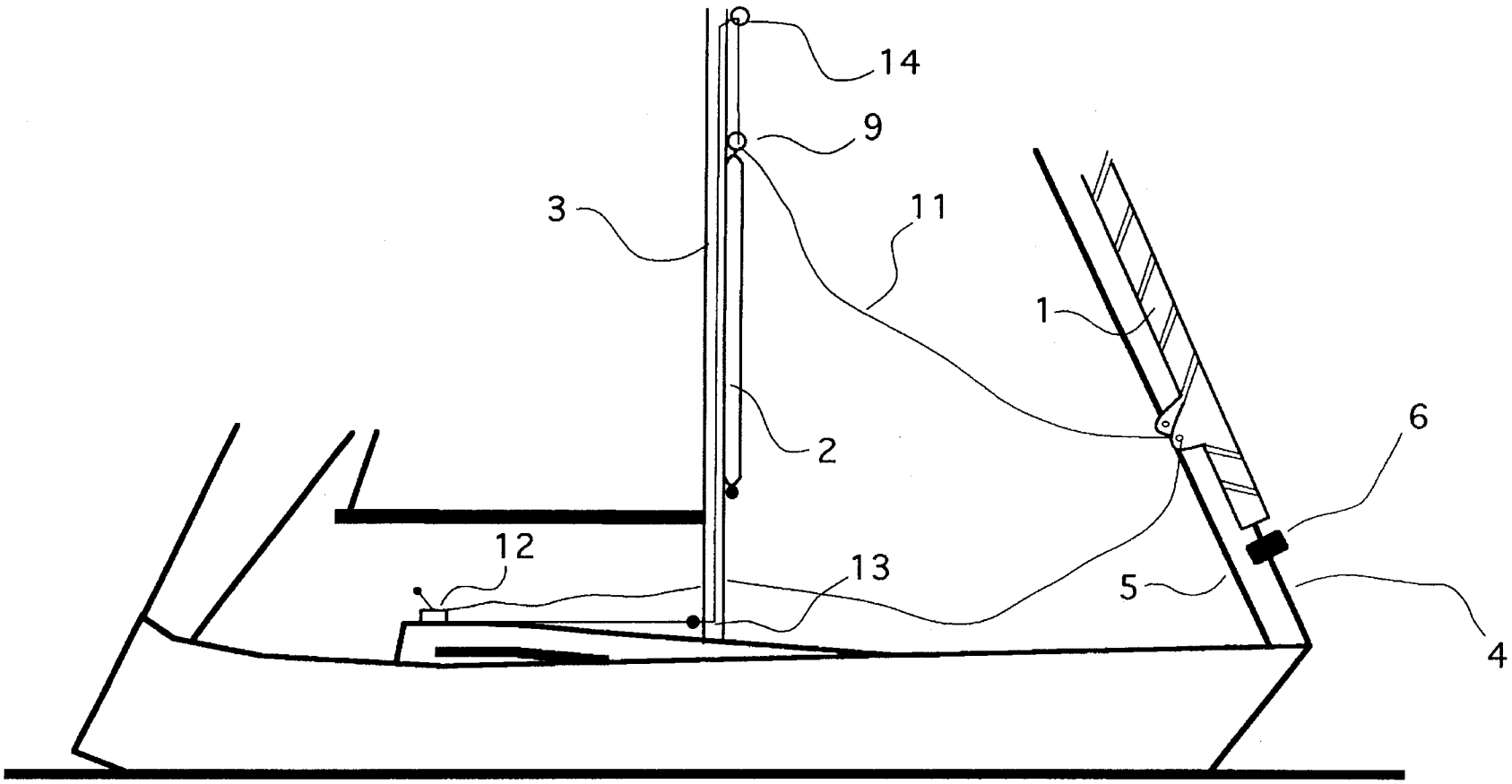
FIG. 4 gives a partial view of the sail-boat according to FIG. 1, the spinnaker being furled and the swivel-mounted boom being raised.

With reference to FIG. 4, a part of the sail-boat shown in FIG. 1 is shown, the spinnaker 1 being furled about the offset stay 4 by means of the furling device 6. The furling end of this furling device 6 is not shown but is of conventional design.

The furling of the spinnaker 1 on the furling device 6 takes place on a dual thickness since the furling operation is done on the basis of the central part of the belly of the spinnaker. Once the spinnaker 1 is completely furled about the furling device 6, only the tacks 8 and the sheet 7 of this cloth remain accessible.

According to FIG. 4, the swivel-mounted boom 2 is shown in a raised position. The circular sheet 11, knotted to the far end 9 of the boom 2, passes through a point 14 located on the mast 3 at a predetermined height so that the circular sheet 11 can act as a topping lift for the swivel-mounted boom 2. This point 14 may be fixed sufficiently high on the mast to enable the use of booms of several lengths that can permit possibly greater surface areas of spinnaker. After having travelled along the mast 3, the circular sheet 11 is brought to the foot 13 of the mast 3 and tautened on a cleat 12 so as to keep the swivel-mounted boom 2 in a raised position.

Furthermore, the circular sheet 11 goes through the tack 8 of the spinnaker 1. The sheet point 7 of the spinnaker, which is also free and non-furled is, for its part, provided with a sheet that is also drawn back into the cockpit of the sail-boat but is not shown for purposes of the clarity of the description.

The circular sheet 11 therefore forms a means to maneuver the swivel-mounted boom 2 and set up a guiding path for the far end 9 of this boom up to the tack 8 of the spinnaker. When the swivel-mounted boom 2 is in a raised position, the front part of the sail-boat is freed. It may be noted, that in order not to hamper the deployment of the jib, the end of the circular sheet 11 which is not frapped to the cleat 12 could be sufficiently slackened.

Figure 5:
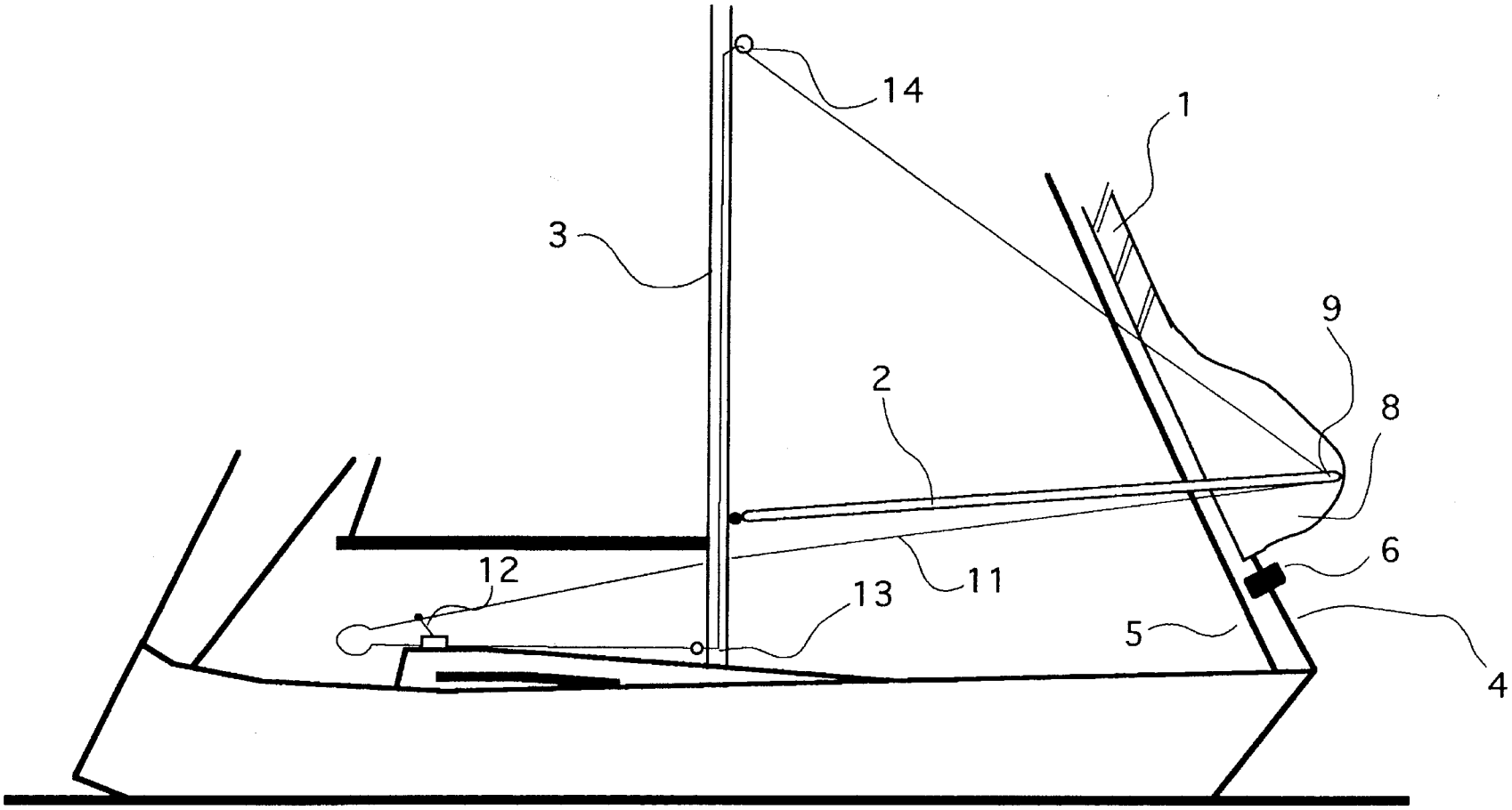
FIG. 5 gives a partial view of the sail-boat according to FIG. 1, the spinnaker being furled and the swivel-mounted boom being lowered.

Referring to FIG. 5, when the spinnaker has to be unfurled, the circular sheet 11 is released from the cleat 12 so as to permit the positioning of the swivel-mounted boom 2 in a lower position, namely in a position essentially perpendicular to the mast 3. Since the circular sheet 11 goes through the tack 8 of the spinnaker, the swivel-mounted boom 2 obligatorily comes into contact with this tack. Once the positioning of the boom 2 has been done from the cockpit of the sail-boat, the furling device 6 may be maneuvered so as to gradually and gently release the spinnaker 1. When the spinnaker 1 is sufficiently deployed, the sheet 11 may be tautened so as to give the swivel-mounted boom 2 the desired angle with respect to the direction of the sail-boat. At the same time, the spinnaker sheet secured to the sheet point 7 may be tautened.

When the spinnaker 1 has to be folded, the furling end of the device 6 may be drawn so as to give the longitudinal tube 22 of the furling device a rotation on itself permitting the recall initially of the straps 17 and then of the spinnaker from its central part.

The operation of the spinnaker and of the boom is thus greatly facilitated since it can be done from the cockpit of the sail-boat.

Figure 6:
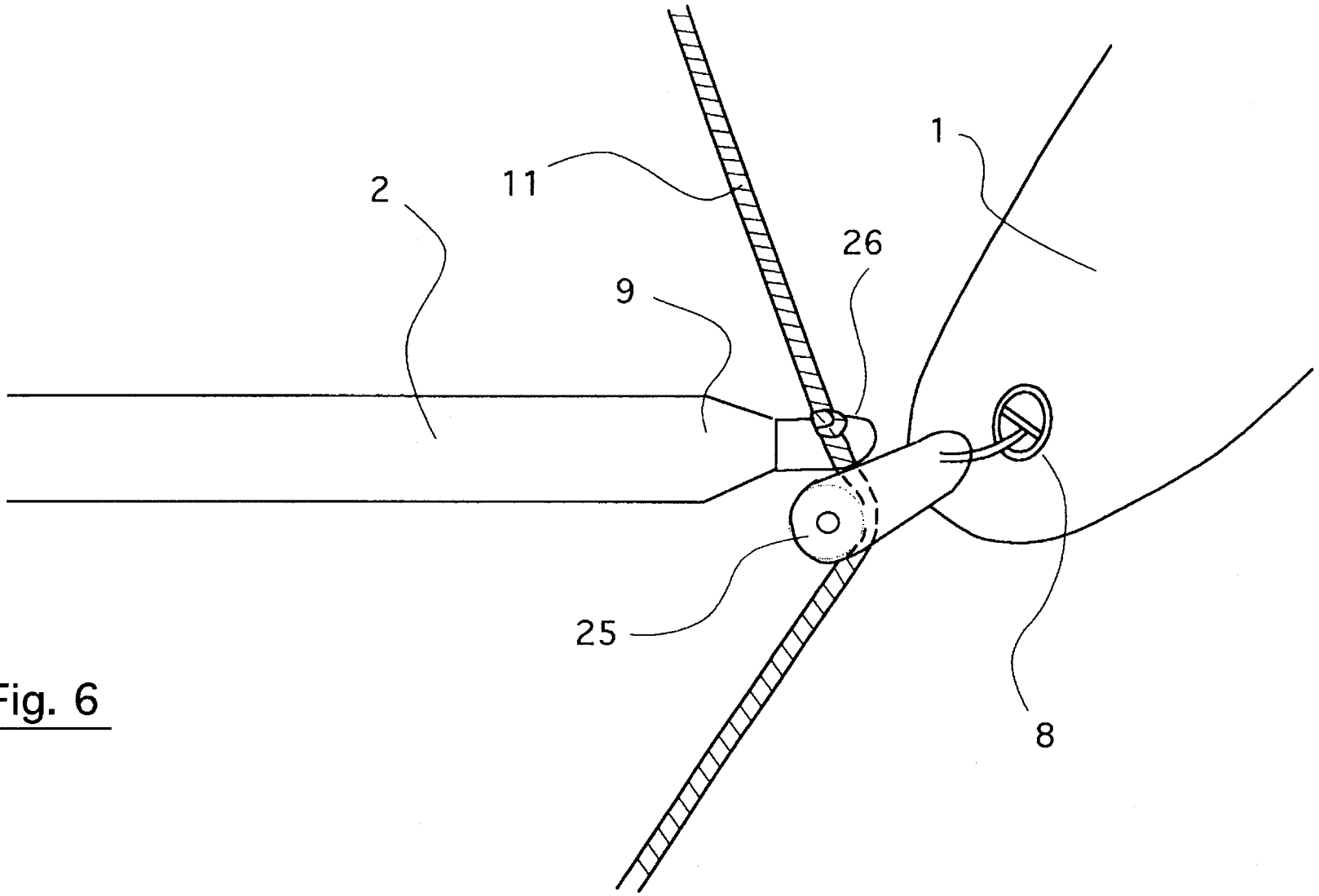
FIG. 6 shows the end of the boom when it is lowered to the level of the non-furled ends of the spinnaker.

With reference to FIG. 6, the far end 9 of the swivel-mounted boom 2 is provided with means 26 enabling the circular sheet 11 to be knotted in such a way that it can enable the organizing of the raising and lowering of the swivel-mounted boom 2. This far end 9 may work together with a pulley 25 through which there passes the circular sheet 11, this pulley 25 being fixed to the tack 8 of the spinnaker 1 so as to securely fix the positioning of the spinnaker on the swivel-mounted boom 2.

Figure 7:
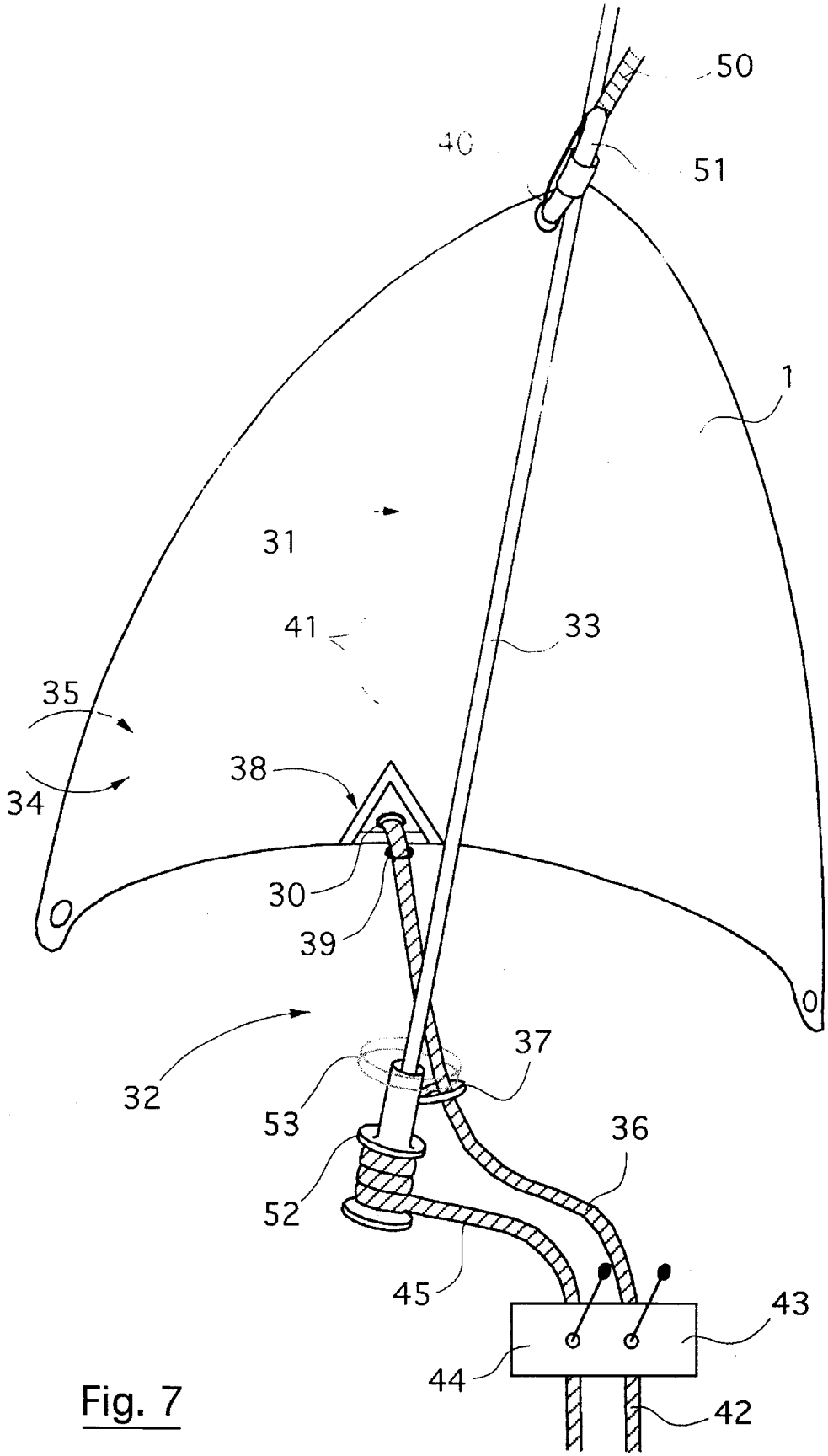
FIG. 7 shows an improved system for the operation of a spinnaker at a distance.

FIG. 7 shows an improved system for the long-distance maneuvering of the spinnaker according to which the spinnaker 1, shown in an unfurled position, is tensioned in its upper part by a halyard 50 connected to a hook 51 going through a halyard point 40.

The spinnaker 1 is furthermore provided with a becket 30 located along the median line 31 of the spinnaker, preferably at the base of said spinnaker. The becket 30 is placed to the center of a zone of said spinnaker that is reinforced, for example by means of pieces of stiffening fabric stitched and/or bonded to the spinnaker.

The sail-boat is furthermore provided with a furling element 32 comprising a furling drum 52 (or any other system to channel this furling) rotationally driving the furling web 33 that extends over at least a part of the height of the spinnaker 1. The furling web is for example a furling tube or a pay-out cable or any cording or any other device enabling the furling of the spinnaker.

Advantageously, said furling web 33 has a diameter great enough to limit the number of turns to which the furling means must be subjected in order to completely fold the spinnaker.

The drum 52 of the furling means receives a furling sheet 45 fastened to a cleat 44. The furling drum advantageously has a recall means providing for the automatic rotation of the furling web in one of the rotational directions when the sheet 45 is released.

The maneuvering device of the spinnaker according to the invention has a attachment sheet 36 that goes through the becket 30, moves through a onward sending 37 secured to the furling means 32 and is frapped in a cleat 43. This sheet 36 is used as a flexible link that makes the becket 30 get attached flat against the furling means 32 during the exertion of a tensile force on the sheet 36, and then the rotation of the spinnaker about the web 33.

According to the invention, this furling operation may be performed in at least two modalities.

According to a first modality, the attachment sheet 36 is provided with a knot (not shown) facing the external face of the becket 30 located on the convex external face side of the spinnaker 1. Consequently, when the crew member of the sail-boat exerts a tensile force on the attachment sheet 36, the knot exerts pressure on the external face of the becket 30 which is driven towards the furling means 32 and finally gets positioned against the shackle 37. At this time, the maneuvering end 42 of the attachment sheet 36 may be frapped in the cleat 43 and then the crew member may maneuver the furling sheet 35 to enable the furling of the furling element 32.

The shackle 37 is advantageously fixedly joined to the furling means 32. In this case, it is necessary to gradually allow the attachment sheet 36 to run as and when the furling is done through the furling means 32, so as to enable the rotations of the sheet 36 above the drum 52. Advantageously, a specific flange 53 will be provided guiding the winding of the attachment sheet 36 about the furling means 32, so as to prevent interference between the two sheets 36, 45 or other elements of the superstructure.

According to a second modality, said attachment sheet 36 is extended on the external convex face side 35 of the spinnaker towards the upper part of the spinnaker and the halyard point 40 where it is secured. So as to guide this motion, the attachment sheet 36 moves advantageously through guide loops 41 distributed along the median line 31 of the spinnaker or in a scabbard or any other guiding means.

According to this second modality, a tensile force on the attachment sheet 36 then has the effect of gradually attaching the spinnaker all along its height against the furling web 33. This embodiment makes it easier to carry out the folding operation in the event of high wind.

It will be noted that this second modality of the invention has the advantage of exerting the force of attachment of the spinnaker on the furling web 33 by a force of pressure and not by a tensile force as in the embodiment of the above-mentioned prior art patent application Ser. No. 9,210,888. The result thereof is a decrease in the strains borne by the corresponding parts of the spinnaker which can thus be made of a less resistant and lighter material with an increased lifetime.

Advantageously, the attachment sheet 36 can also be provided with a knot 39 on the internal face of the becket 30 on the internal concave face side 34 of the spinnaker 1. This knot 39 limit the travel of the sheet 36 in preventing it from escaping through the becket 30.

Advantageously, the cleats 43 and 44 have a mechanism providing for the release of the attachment sheet 36 as and when the furling sheet 45 is maneuvered.

It will be furthermore noted that the spinnaker 1 is preferably secured to the furling web 33 at the halyard point 40 so as to be capable of being rotationally driven simultaneously at its base and its summit during the folding operation.

Figure 8:
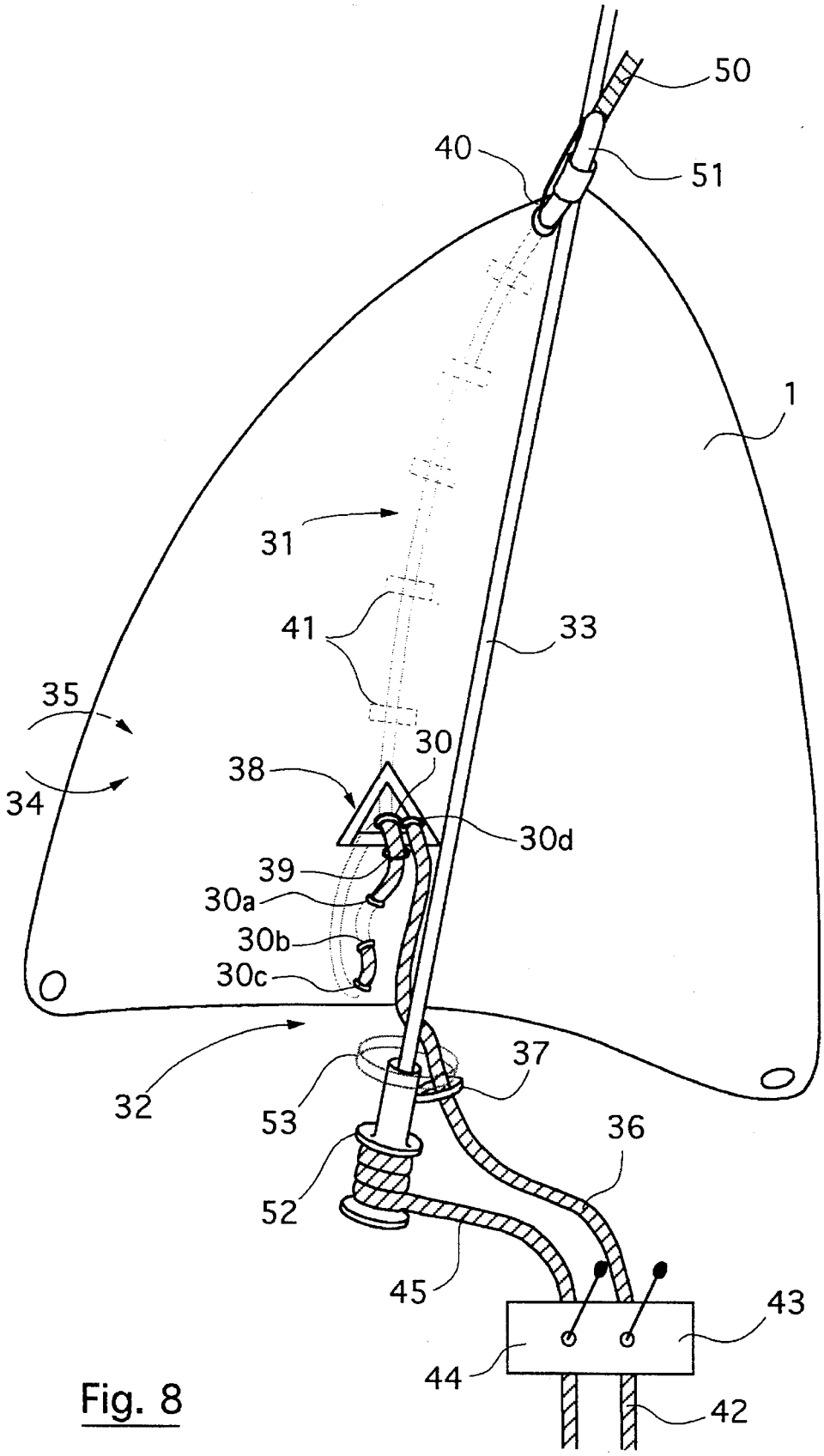
FIG. 8 shows a system similar to that of FIG. 7 but including means for the concertina-type folding of the lower part of the spinnaker.
Figure 9:
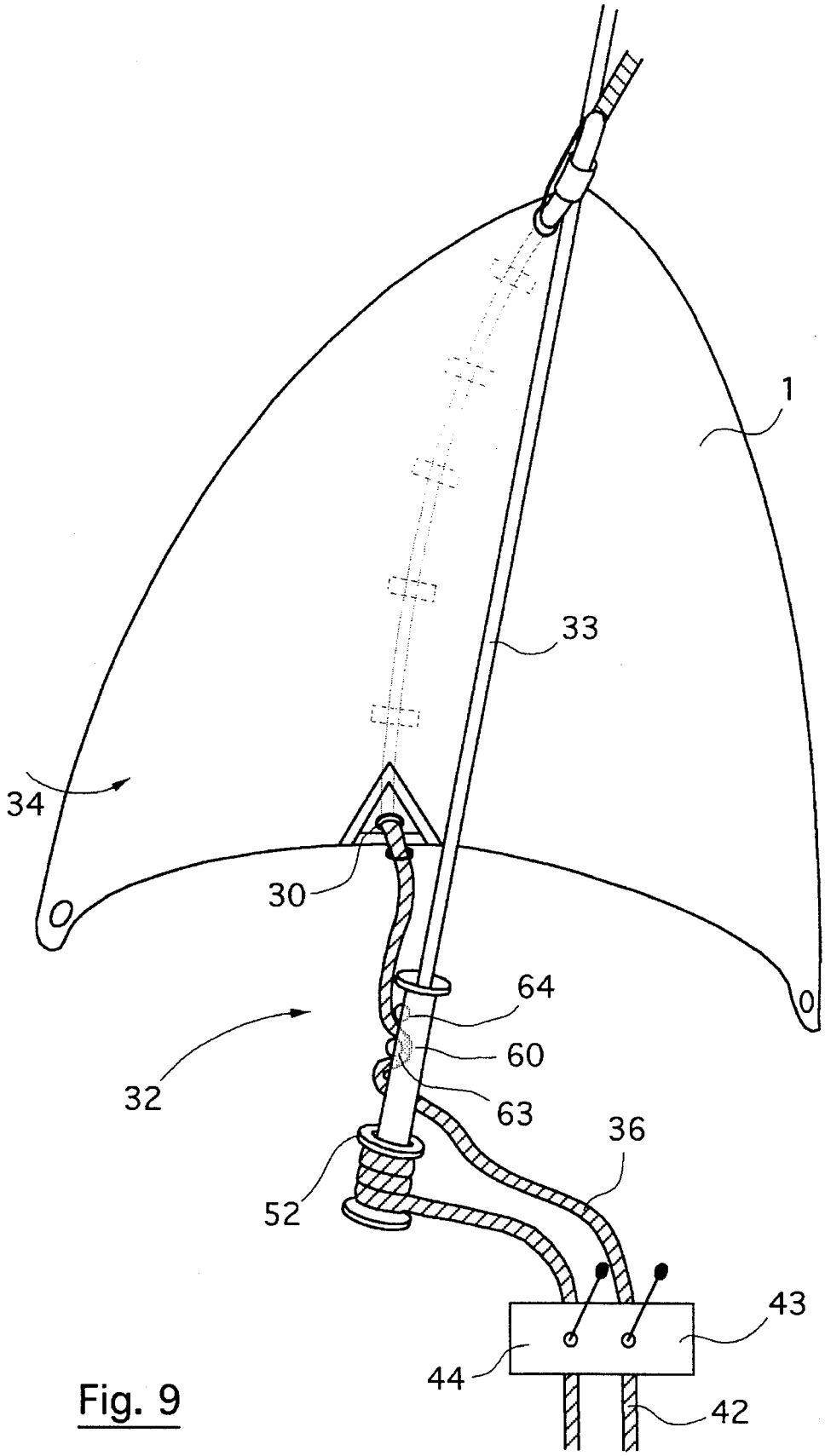
FIG. 9 shows a system similar to that of FIG. 7 including a furling machine according to the invention.

With reference to FIG. 8, another embodiment is shown wherein the attachment sheet 36 extends into the lower part of the spinnaker, alternately on the concave internal face side and the convex external face side of the spinnaker in passing through beckets 30*a*, 30*b*, 30*c* and then rises to a becket 30*d* located near the becket 30. It will be noted that provision could be made for additional beckets at the position of the becket 30 to adapt the paths of passage of the sheet. By tautening the sheet 36, it is thus possible to achieve a concertina folding of the lower part of the spinnaker. A possibility of this kind proves to be particularly useful when it is desired to use a spinnaker having a surface area greater than the maximum theoretical surface area defined in terms of height by the height of the furling web 33. It will be noted that, just as in the case of the becket 30, the beckets 30*a*, 30*b*, 30*c*, could also be stiffened. According to yet another embodiment of the invention shown in FIG. 9, the sail-boat is furthermore provided with a furling element 32 including an essentially cylindrical part 60 positioned around the furling web 33 in a manner such that it is secured to it and abuts the upper flange of the rolling drum 52 of the furling element 32. This part is provided with two pulleys 64, 63 mounted essentially radially with respect to the longitudinal axis in the upper part of said part 60 facilitating the winding of the attachment sheet. The pulleys 64 and 63 are the onward sending point of said attachment sheet 36 which passes between these pulleys and makes it possible to prevent the attachment sheet from getting jammed between the part 60 and the drum 52.

The upper pulley 64 is flush with the surface of the part 60 to a slightly greater degree than the lower pulley 63 so as to well move away the attachment sheet 36 from this part at its arrival between the two pulleys.

The sheet 36 coming from the spinnaker arrives between the two pulleys and goes behind the lower pulley 63 before getting furled about the lower part of the part 60 during the activation of the furling element 32.

Figure 10:
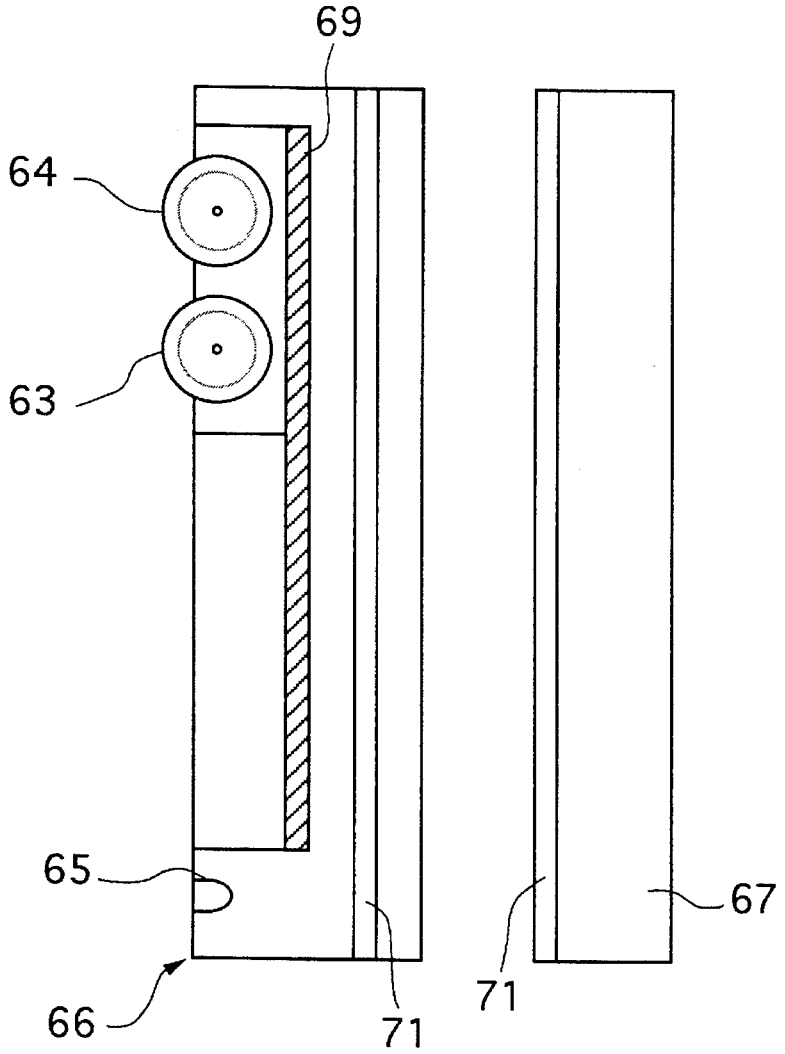
FIG. 10 shows a longitudinal sectional view of an embodiment of the furling element.
Figure 11:
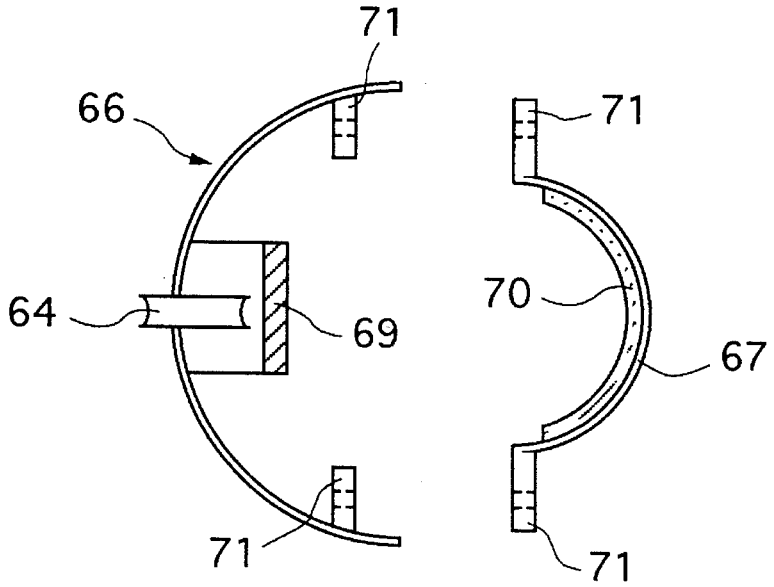
FIG. 11 shows a cross-sectional view of the complementary elements forming the furling element shown in FIG. 10.

According to FIGS. 10 and 11, the part 60 is formed by two complementary elements 66 and 67 designed to be assembled about the web 33 of the furling element so as to wedge it and be fixedly joined to it. To this end, the elements 66, 67 have internal supporting surfaces 69 and 70 for the web 33 of the furling element 32 which are advantageously covered with a material such as foam to receive the web. In order to join the two complementary elements 66, 67, stops 71 designed to work with each other by means of fastening means are planned.

Furthermore, means 65 for the fastening to the upper flange of the drum 52 of the furling element 32 are planned. These means are formed by a yoke to which there may be fixed a small shackle also working with this flange and making it possible to prevent the part 60 from sliding along the web 33 and rising along it.

It will be noted that the complementary elements 66 and 67 could be designed so that the part 60 is closed in its upper part when it works together with the web 33.

Figure 12:
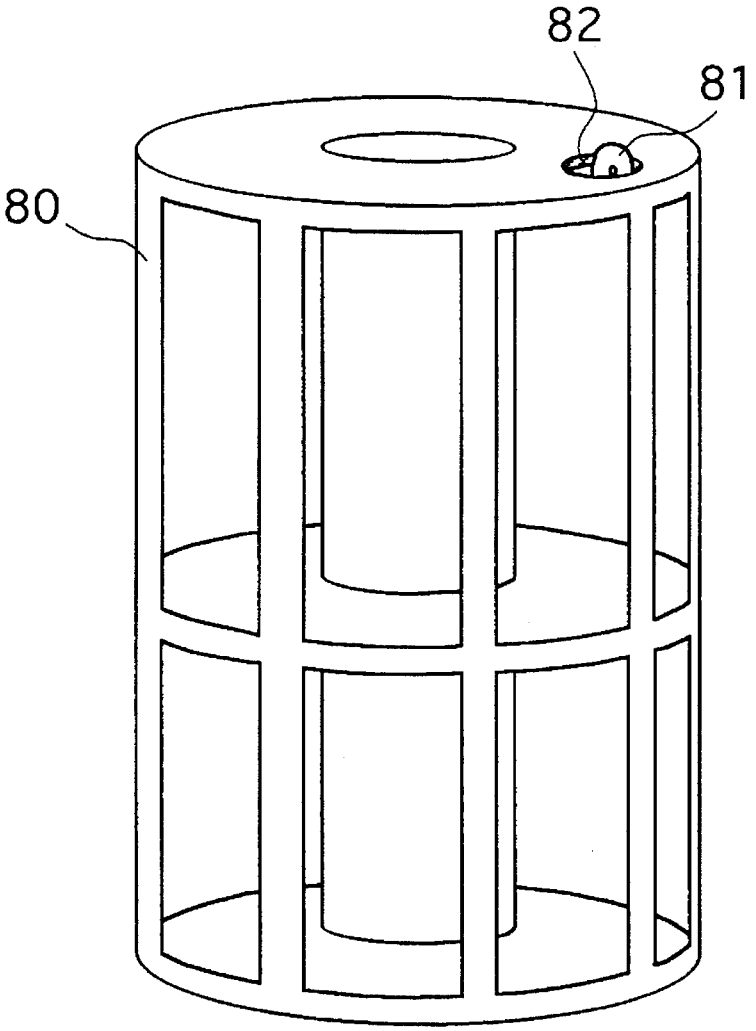
FIG. 12 shows a dual-drum furling device modified according to the present invention.

As can be seen in FIG. 12, it is also possible to use, as a furling element, a dual drum modified according to the invention:

by a cage 80 fixed about the drums of the furling device and enabling the guidance of the attachment sheet 36; and by a pulley 81 fixed to the entry hole 82 of the upper flange and enabling the sliding of the attachment sheet and preventing it from being worn out by friction on the edge of said hole.

Figure 13:
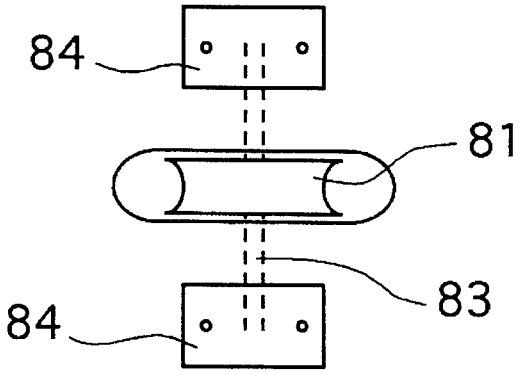
FIG. 13 shows a detailed view of FIG. 12 representing the pulley in a top view and its fastening means.

With reference to FIG. 13, the pulley 81 is positioned so that its rotational axis 83 is perpendicular to the radius of the upper flange of the dual drum. This shaft is secured at each of its ends by an upper plate 84 and a lower plate (only the upper plates 84 are seen in FIG. 13) fixed respectively to the upper surface and lower surface of the upper flange.

This is only one particular mode of fastening. Other modes of fastening may be used without departing from the context of the invention.

The embodiments of the invention described herein are not designed to reduce its scope and may be the object of modifications without departing from the context of the invention, within the limit of the characteristics defined in the claims.

I claim:

1. A system designed to be installed on a sail-boat in order to enable furling of a spinnaker of said sail-boat and positioning, at a distance, of said spinnaker on a boom swivel-mounted on mast of said sail-boat, said system comprising;

an offset stay, offset with respect to jib stay, connecting a top of the mast to a fastening point located on a bow of said sail-boat;

a furling device secured to said offset stay;

at least one boom swivel-mounted to the mast;

a flexible link provided at a central part of the spinnaker and attached to the furling device to enable furling of said spinnaker on a double thickness, starting from said central part, in such a way that only a sheet point and tack of said spinnaker remain accessible once the spinnaker is totally furled; and a circular sheet knotted at a far end of said swivel-mounted boom and passing through the tack of said spinnaker by a foot of the mast and by a point of the mast located at a predetermined height on the mast so that said circular sheet serves as a topping lift for said swivel-mounted boom, said circular sheet being capable of being frapped to a cleat and operated from a cockpit of the sail-boat to lower and raise said swivel-mounted boom and bring said far end of the swivel-mounted boom into contact with the tack of said spinnaker.

2. A system according to claim 1, wherein said flexible link connecting the spinnaker to the furling device comprises a set of straps or sheets arranged essentially along a longitudinal axis of said spinnaker and having ends of the straps secured to an essentially rectangular band.

3. A system according to claim 1, wherein said flexible link comprises a single strap or a single sheet secured to said furling device by means of an essentially triangular cloth band fixed to said furling device.

4. A system according to claim 3, wherein said essentially triangular band is provided with reinforcing pieces each positioned so as to face a section of a tube (22) of said furling device.

5. A system according to claim 3 wherein said straps or said sheets can be adjusted lengthwise so as to be capable of matching a surface area of the spinnaker.

6. A system according to claim 5, wherein said central part of the spinnaker receiving said flexible strap includes a reinforcing piece.

7. A system according to claim 6, wherein said flexible link connecting said spinnaker to said furling device is fixed approximately at a part of the spinnaker that is at a greatest distance from the furling device when the spinnaker is filled with wind.

8. A system according to claim 1 wherein said offset stay supporting the furling device is offset longitudinally before said jib stay.

9. A system according to claim 8 wherein said tack of said spinnaker includes a pulley receiving said circular sheet and being capable of working with the far end of said swivel-mounted boom.

10. A system according to claim 9, further comprising a second swivel-mounted boom on the mast and a second circular sheet, one of the swivel-mounted booms being designed for maneuvering the spinnaker on a portside by means of the circular sheet and the other of the swivel-mounted booms being designed for starboard maneuvering of the spinnaker by means of the second circular sheet.

11. A system according to claim 10, wherein borders of said spinnaker have a reinforcement piece treated so as to withstand natural ultraviolet rays.

12. A device for the maneuvering of a spinnaker having a becket located substantially at a point of a median line of the spinnaker, said maneuvering device comprising;

a furling element having a furling web extending over at least a part of the height of the spinnaker on a concave internal face side of said spinnaker; and an attachment sheet that can be secured to a fastening point of said spinnaker and that crosses said becket towards an onward sending point located on said furling element.

13. A device according to claim 12, wherein said becket is localized in a vicinity of a median part of a base of said spinnaker.

14. A device according to claim 13, wherein said becket is pierced in a reinforced region of said spinnaker.

15. A device according to claim 14, wherein said onward sending point for said attachment sheet comprises a shackle.

16. (Amended) A device according to claim 15, wherein said attachment sheet comprises at least one locking knot designed to abut an internal face or an external face of said becket during a maneuver operation.

17. A device according to claim 16, wherein said attachment sheet is extended, on a convex external face of the spinnaker, towards an upper part of the spinnaker to force attachment of said unfurled spinnaker towards a direction of said furling web when a tensile force is exerted on said attachment sheet.

18. A device according to claim 17, wherein said attachment sheet is fixed substantially at a halyard point of said spinnaker.

19. A device according to claim 18, wherein said attachment sheet is guided along the convex external face of said spinnaker by guide loops attached to spinnaker.

20. A device according to claim 19, wherein said guide loops extend substantially along the median line of said spinnaker.

21. A device according to claim 20, wherein a maneuvering end of the attachment sheet is frapped on a cleat.

22. A device according to claim 21, wherein said cleat works together with a twin cleat designed to frap a sheet for controlling rotation of said furling web.

23. A device according to claim 22, wherein said attachment sheet is extended into a lower part of the spinnaker alternately on an internal concave face side and the external concave face side of the spinnaker and then raised to a level of said becket so as to cause concertina-type folding of said lower part of the spinnaker when the attachment sheet is tautened.

24. A device according to claim 23, wherein said furling element is fitted out with an essentially cylindrical part designed to be positioned about said furling web so as to be secured to it and abut an upper flange of a furling drum of said furling element, said cylindrical part being provided with at least one pulley essentially mounted radially with respect to the longitudinal axis of said cylindrical part and constituting said onward sending point for said attachment sheet.

25. A device according to claim 24, wherein said pulley is designed to be in the upper part of said essentially cylindrical part.

26. A device according to claim 25, wherein said pulley is flush with a surface of said cylindrical part so as to go slightly beyond it.

27. A device according to claim 26, further comprising two pulleys positioned in a same vertical plane, said attachment sheet arriving between the two pulleys.

28. A device according to claim 27, wherein an upper pulley of the two pulleys emerges further out of said cylindrical part than a lower pulley of the two pulleys.

29. A device according to claim 28, wherein said essentially cylindrical part includes means for anchoring the furling element to the furling drum.

30. A device according to claim 29, wherein said essentially cylindrical part is integrated into said furling element.

31. A device according to claim 30, wherein said essentially cylindrical part comprises at least two complementary elements that can be adapted around the furling web.

32. A device according to claim 23, wherein said furling element comprises a dual drum having constituent drums provided with a case facilitating winding of the attachment sheet.

33. A device according to claim 32, wherein an entry hole of the upper flange is provided with an element facilitating sliding of the attachment sheet.

34. A device according to claim 33, wherein said element facilitating sliding is a pulley.

* * * * *

UNITED STATES PATENT AND TRADEMARK OFFICE
CERTIFICATE OF CORRECTION

PATENT NO. : 5,535,693

DATED : July 16, 1996

INVENTOR(S) : Verslype

It is certified that error appears in the above-identified patent and that said Letters Patent is hereby corrected as shown below:

In column 9, line 52, "i" should read --1-- (number 1).

In column 14, claim 1, line 5, insert --a-- after the word "on".

In column 14, claim 1, line 6, insert --a-- after the word "to".

In column 14, claim 2, line 31, insert --fixed to said furling device-- after the word "band".

In column 15, claim 16, line 18, delete "(Amended)" before "A".

Signed and Sealed this

Twenty-fourth Day of June, 1997

Bruce Lehman

*Attest:*

BRUCE LEHMAN

*Attesting Officer*

*Commissioner of Patents and Trademarks*